US005433027A

United States Patent [19]

Sprangers

[11] Patent Number: 5,433,027

[45] Date of Patent: Jul. 18, 1995

[54] DOUBLE BARREL BREAK-ACTION SHOTGUN

[75] Inventor: Keith J. Sprangers, Racine, Wis.

[73] Assignee: U.S. Competition Arms, Inc., Racine, Wis.

[21] Appl. No.: 146,537

[22] Filed: Nov. 1, 1993

Related U.S. Application Data

[62] Division of Ser. No. 928,117, Aug. 11, 1992, Pat. No. 5,349,773.

[51] Int. Cl.[6] ..... F41A 3/58

[52] U.S. Cl. ..... 42/45

[58] Field of Search ..... 42/40, 41, 44, 45

[56] References Cited

U.S. PATENT DOCUMENTS

| | | | |
|---|---|---|---|
| 288,618 | 11/1883 | Burkhard et al. | 42/44 |
| 294,772 | 3/1984 | Davis | 42/44 |
| 386,174 | 7/1898 | Whitmore | 42/44 |
| 1,054,069 | 2/1913 | Wilson | 42/44 |
| 2,088,173 | 7/1937 | Lewis | 42/40 |

FOREIGN PATENT DOCUMENTS

| | | | |
|---|---|---|---|
| 460768 | 12/1913 | France | 42/44 |
| 552254 | 4/1923 | France | 42/44 |

*Primary Examiner*—Stephen M. Johnson
*Attorney, Agent, or Firm*—Nilles & Nilles

[57] ABSTRACT

A double barrel break-action shotgun includes a breech and a mating breech housing. The breech and breech housing include a bifurcated lug which absorbs recoil forces which would otherwise be imposed on the pivot pin via which the breech is connected to the breech housing. A portion of the lug can be replaced by replacing a shoulder insertable in a socket of a portion of the lug, thus maintaining close tolerances between the breech and breech housing.

15 Claims, 13 Drawing Sheets

DOUBLE BARREL BREAK-ACTION SHOTGUN

DISCUSSION OF RELATED APPLICATIONS

This application is a division of U.S. patent application Ser. No. 07/928,117, filed Aug. 11, 1992, now U.S. Pat. No. 5,349,773.

BACKGROUND OF THE INVENTION

1. Field of Use

This invention relates to a double barrel break-action shotgun and, in particular, to an improved lug for connecting the breech or barrel rear end to the receiver of the shotgun.

2. Description of the Prior Art

Double barrel break-action shotguns for trap shooting, hunting, and other purposes are well known. Trap guns typically incorporate rugged structural features as well as various sophisticated features and refinements which enhance the utility, accuracy, and ease of handling, thus facilitating their use for the sport of trap shooting.

These shotguns typically include a metallic receiver and a trigger housing which is provided in the receiver and which houses a firing mechanism including a trigger, a pair of sears, and a pair of hammers. A selector switch cooperates with an acorn device to permit the selection of one or the other of the hammers and thus of one of the two barrels of the shotgun. A breech housing is connected to the receiver and receives a breech which is pivotable out of the housing to permit insertion and extraction of shotgun shells. Opening of the breech is made possible via actuation of a lever which withdraws a bolt from the breech.

The typical shotgun of the type discussed above exhibits several drawbacks and disadvantages.

For instance, the breech of a typical trapshooting shotgun is connected to the breech housing only by the pivot pin which allows the breech to be broken away from and pivoted with respect to the breech housing. This pin is subject to wear from the high stresses imposed on it during recoil of the shotgun. As a result, play is often formed between the breech and the breech housing after only a few firings, thus destroying the desired tolerances between the breech and the breech housing.

OBJECTS AND SUMMARY OF THE INVENTION

It is an object of the invention to provide a shotgun including an abutment device which provides a connection of a breech or barrel rear end of a shotgun to the breech housing which retains the desired tolerances, even after repeated firings, and which upon wear or damage, can be easily replaced with a new abutment device.

In accordance with this aspect of the invention, the abutment lug includes a first abutment lug provided on one of the breech housing and the breech barrel, and a second abutment lug including a replaceable shoulder which is provided on the other of the breech housing and the barrel. The shoulder and the first abutment lug abut one another to provide a snug engagement between the barrel and the breech housing.

Advantageously, the first abutment lug is formed integral with the housing, and the shoulder is insertable into the barrel. A retaining screw may be provided in the breech to fasten the shoulder in the breech.

Another object of the invention is to provide a process of compensating for lug wear. In accordance with another aspect of the invention, this object is achieved by replacing a shoulder, inserted into a socket formed in the abutment lug, and then fastening the shoulder to the abutment lug.

Other objects, features, and advantages of the present invention will become apparent to those skilled in the art from the following detailed description. It should be understood, however, that the detailed description of the specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being had to the accompanying drawings in which like referenced numerals represent like parts throughout, and in which.

DETAILED DESCRIPTION OF THE PREFERRED EMBODIMENTS

Pursuant to the invention, a double barrel break-action shotgun includes a breech or barrel rear end and a mating breech housing. The breech and breech housing include a bifurcated lug which absorbs recoil forces which would otherwise be imposed on the pivot pin. A portion of the lug can be replaced with a minimal of effort upon wear or breakage by replacing a shoulder insertable in a socket, in a portion of the lug, thus maintaining close tolerances between the breech and breech housing.

Figure 1:
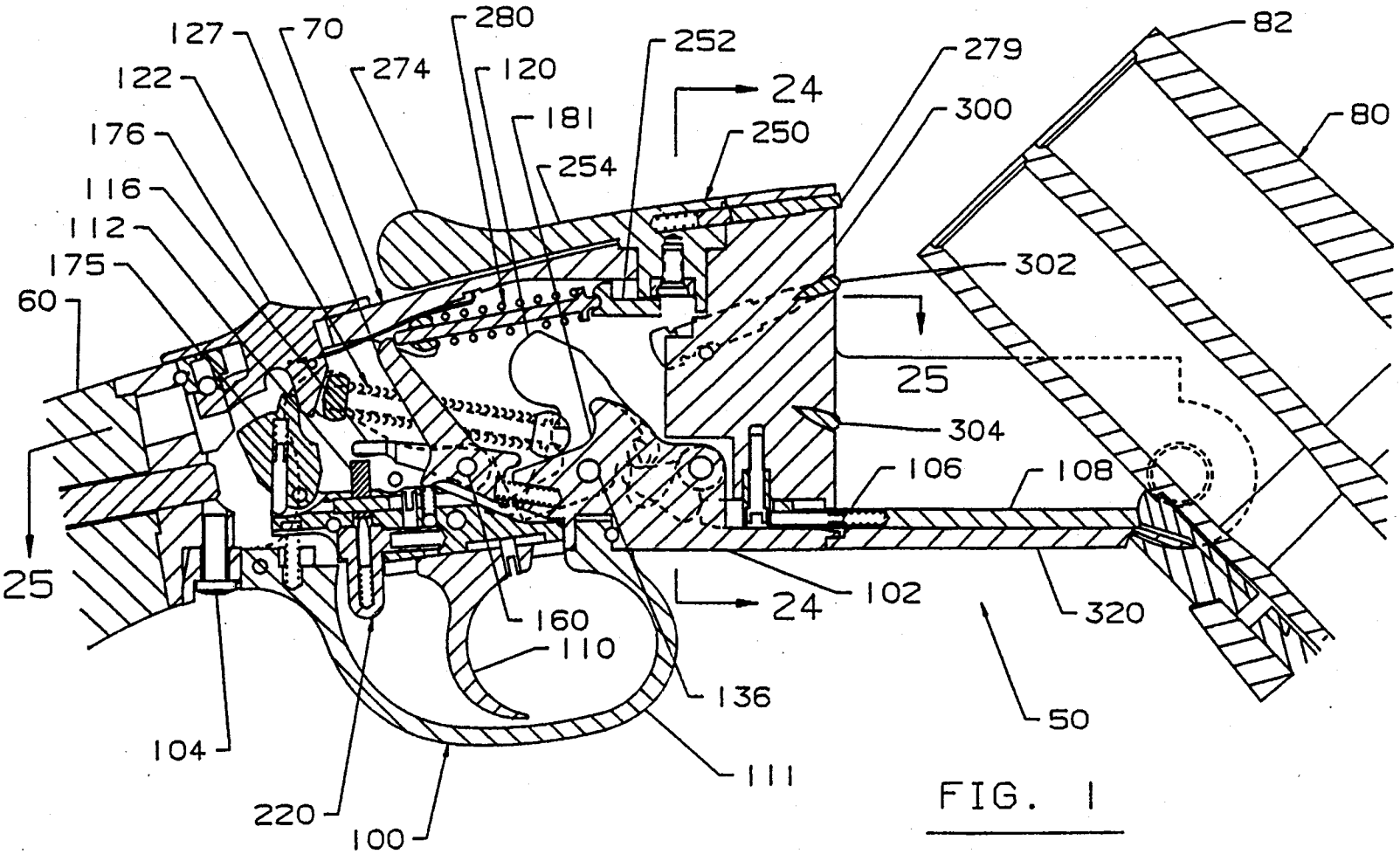
FIG. 1 is an elevation view, illustrated in cross-section through the longitudinal center line of the gun, of a portion of a shotgun constructed in accordance with the present invention.
Figure 2:
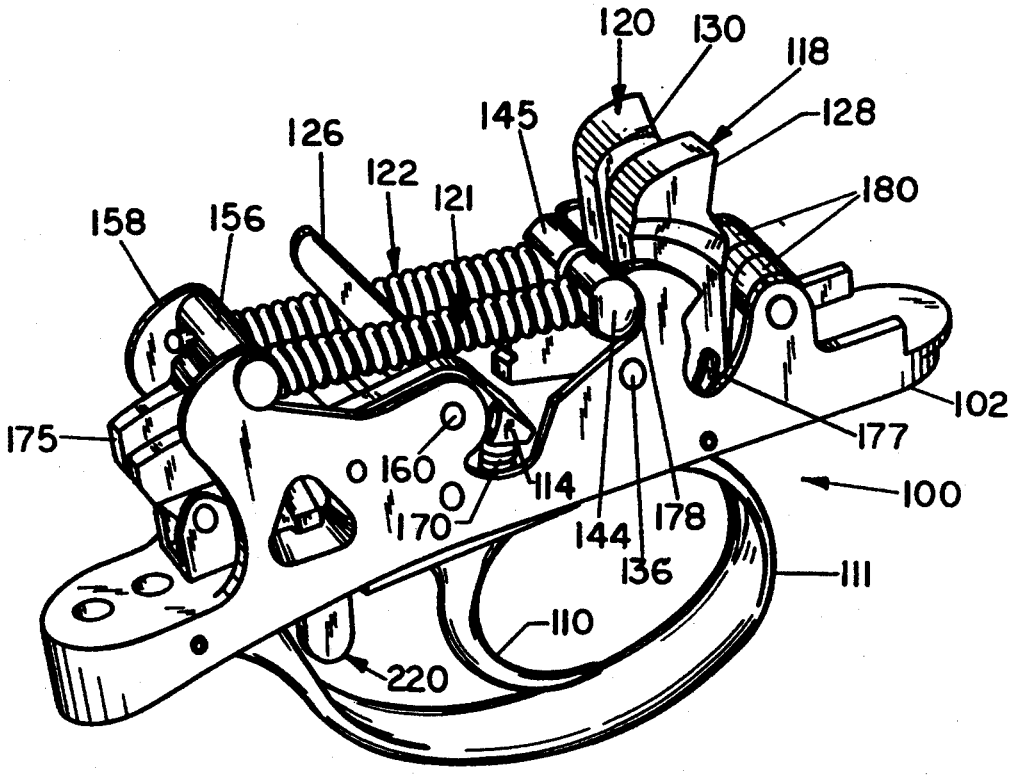
FIG. 2 is a perspective view of a first configuration of a firing mechanism usable in the shotgun of FIG. 1, shown from the right side of the firing mechanism.
Figure 4:
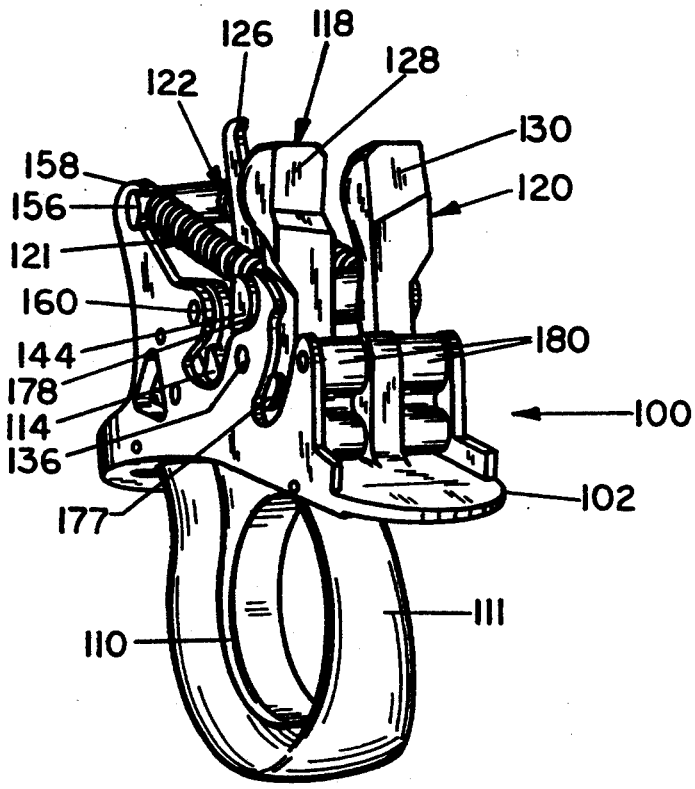
FIG. 4 is an end view of the firing mechanism of FIG. 2.
Figure 3:
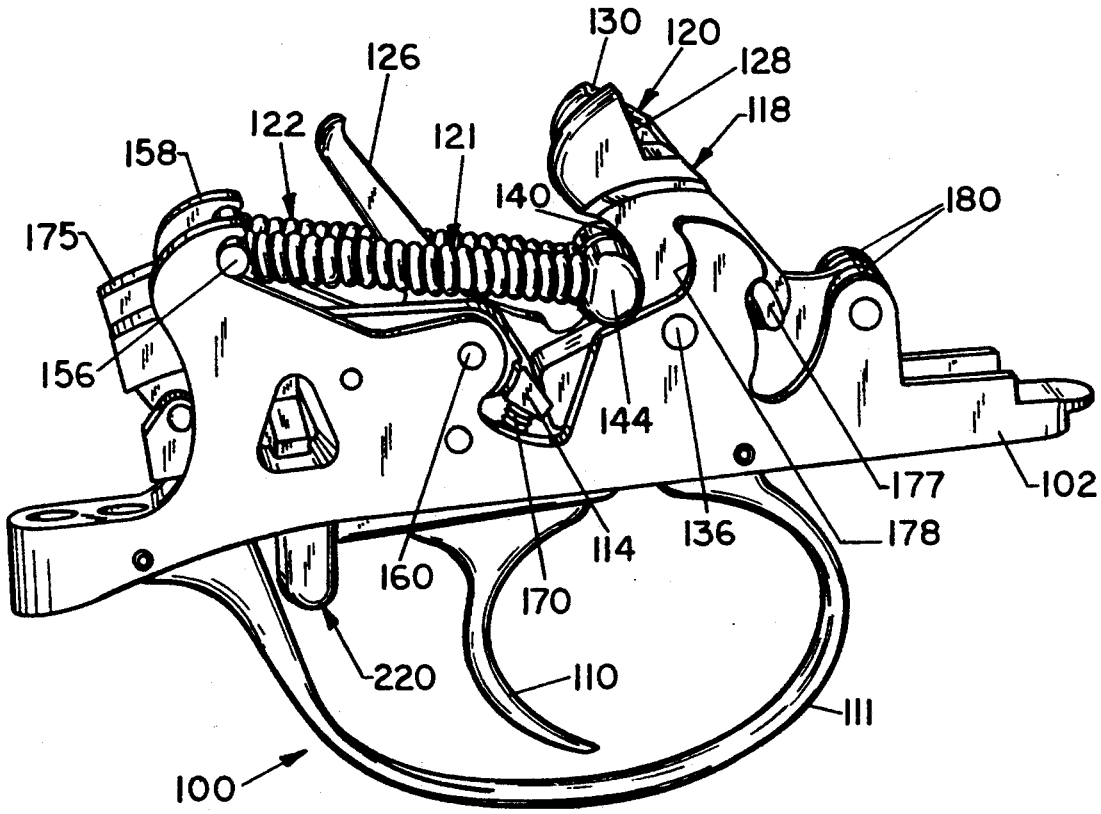
FIG. 3 is a perspective view of the firing mechanism of FIG. 2 with the hammers in their cocked position.
Figure 6:
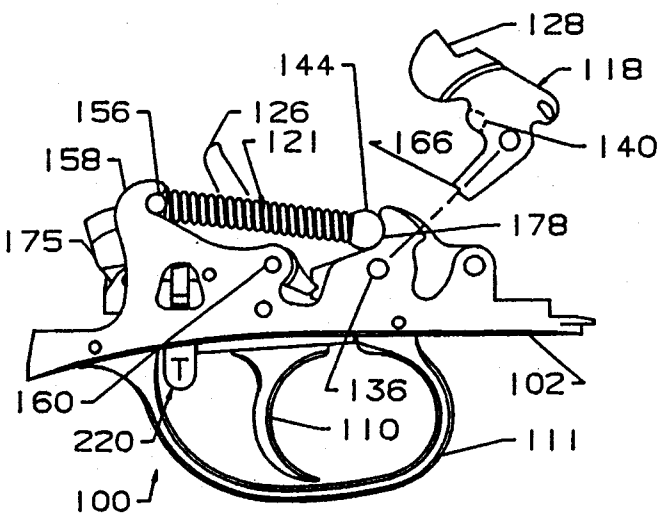
FIG. 6 is an exploded elevation view of the firing mechanism of FIG. 2, with the remaining hammer being separated from the trigger housing.
Figure 7:
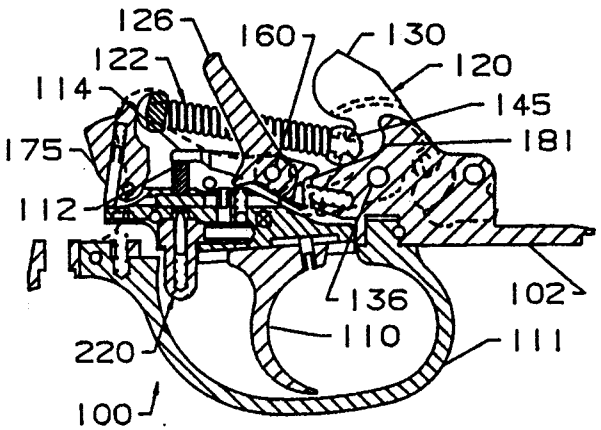
FIG. 7 is a sectional elevation view of the firing mechanism of FIG. 2 taken through a line extending through the longitudinal center line of the firing mechanism.
Figure 8:
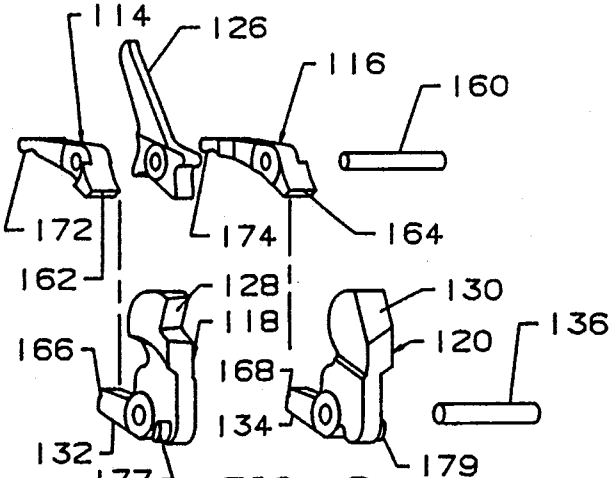
FIG. 8 is an exploded perspective view of the sears, out of battery pawl, and hammers of the firing mechanism illustrated in FIGS. 5–7.
Figure 5:
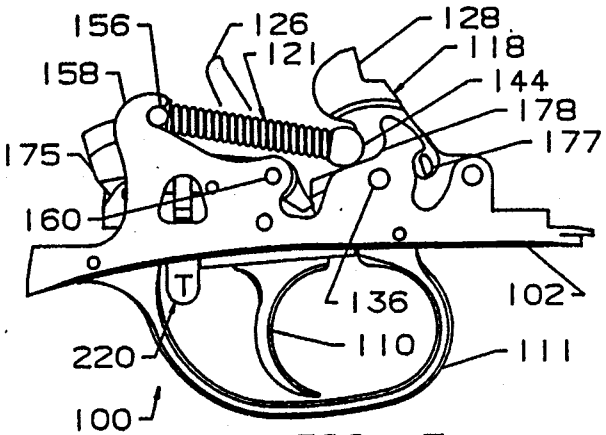
FIG. 5 is an elevation view of the firing mechanism of FIG. 2 with the second hammer removed.

Referring to the drawings, and to FIG. 1 in particular, a shotgun 50 constructed in accordance with the present invention includes a stock 60 and a cast receiver 70 including a retainer for a trigger housing 102, a receiver front wall or breech end 300, and a breech housing 320. The shotgun further includes a double barrel 80 and associated breech 82 which breaks away from the receiver 70 and breech housing 320, and a firing mechanism 100. A bolt actuator 250 is provided for selectively retracting a bolt 252 from a breech 82 of barrel 80 and for locking the bolt in the breech. Firing pins 302, 304 extend through the receiver front wall 300 which, in the illustrated embodiment, is formed integral with the receiver 70.

The Firing Mechanism

1. Rebound System

Figure 20:
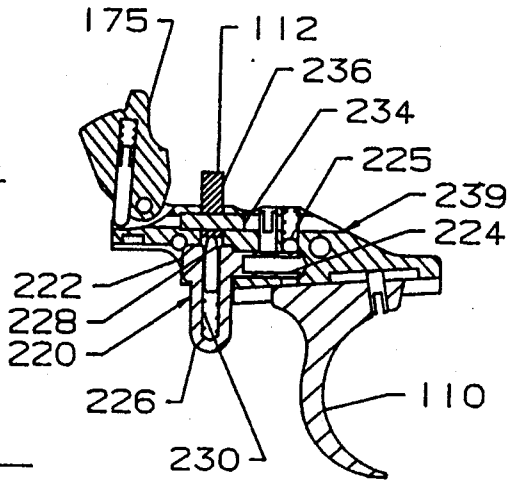
FIG. 20 is a sectional elevation view of a portion of the firing mechanism of the shotgun illustrated in FIG. 1.
Figure 21:
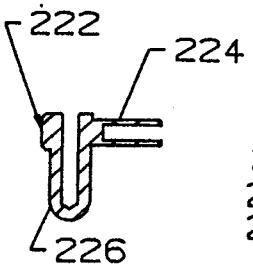
FIG. 21 is a sectional elevation view of a portion the selector switch illustrated in FIG. 20.
Figure 22:
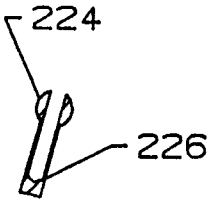
FIG. 22 is a sectional end view of the device of FIG. 21.

Pursuant to the invention, the firing mechanism 100 is operative to positively fire the shotgun 50 and to rebound into a position in which the gun can be opened. More specifically, referring to FIGS. 1–19 and to FIGS. 1–12 in particular, the firing mechanism 100 includes a trigger housing 102 which is received in a recess in the receiver 70 and which is connected to the receiver 70 via suitable connectors such as a screw 104. Disposed within the trigger housing 102 are a trigger 110 provided in a trigger body 239 (FIG. 20), an acorn 112, first and second sears 114 and 116, and first and second hammers 118 and 120. The trigger 110 is surrounded by a conventional trigger guard 111. Mainspring assemblies 121, 122 store potential energy when the hammers 118, 120 are cocked and release this potential energy to fire the gun upon actuation of the trigger 110. An out of battery pawl 126 cooperates with the trigger body 239 to prevent firing of the gun when the bolt actuator 250 is unlocked.

Each hammer 118, 120 includes a contact face 128, 130 for contacting the respective firing pin 302, 304, and a tail 132, 134 for cooperation with the respective sear 114, 116. Each hammer further includes a bore which receives a pivot pin 136 which in turn mounts the hammers on the trigger housing 102. A notch 166, 168 is formed on the tail 132, 134 of each hammer 118, 120 for cooperation with the respective sear 114, 116. Abutment lugs 177, 179 are formed on the sides of the hammers for cooperation with tell-tale rods (not shown). Seats 140, 141 are formed on the hammers 118, 120 for cooperation with mainspring assemblies 121, 122.

The mainspring assembly 121 includes a plunger piston 142 which is soldered or otherwise affixed to a head 144 and which is surrounded by a mainspring 146. Similarly, the mainspring assembly 122 includes a plunger piston 143 which is soldered or otherwise affixed to a plunger head 145 and which is surrounded by a mainspring 148. The free end of each of the plunger pistons 142, 143 is slidably received in a respective bore formed in a support pin 156 fixed to a receptacle 158 of trigger housing 102. Seats 178 and 181 are formed in the trigger housing 102 proximate the hammers 118, 120 and support the mainspring assemblies 121, 122 when the hammers 118, 120 are released.

The sears 114, 116 and the out of battery pawl 126 are supported on the trigger housing 102 by a common pivot pin 160. When a hammer 118 or 120 is in its cocked position, a tooth 162, 164 formed by the upper edge of the slanted front face of the respective sear 114, 116 engages the mating notch 166, 168 in the associated hammer 118, 120, thus retaining the hammer in its cocked position. The sears 114, 116 are biased in this cocked position by biasing springs such as spring 170 cooperating with sear 114 as illustrated in the drawings. The rear leg 172, 174 of each of the sears 114, 116 includes a relatively flat bottom surface for engagement with acorn 112. A spring biased pivot member 175 is connected to the trigger 110 and cooperates with a safety switch 176 to prevent actuation of the trigger when the safety switch is in its active position.

Figure 9:
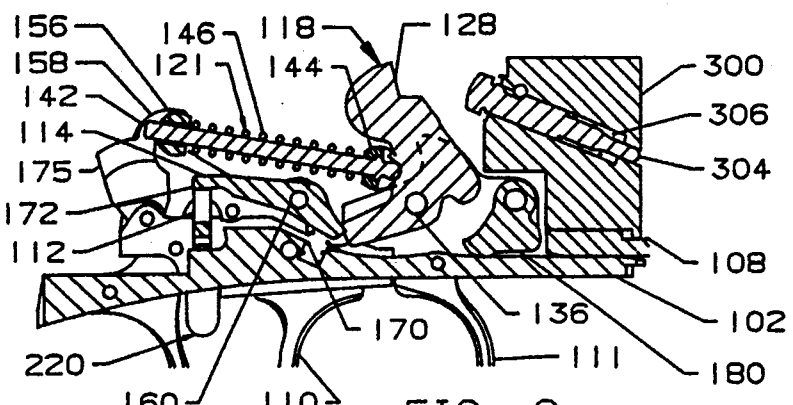
FIG. 9 is a sectional elevation view of the firing mechanism illustrated in FIG. 2 taken through a line extending through the first hammer, with the second hammer removed and with the illustrated hammer shown in its cocked position.
Figure 13:
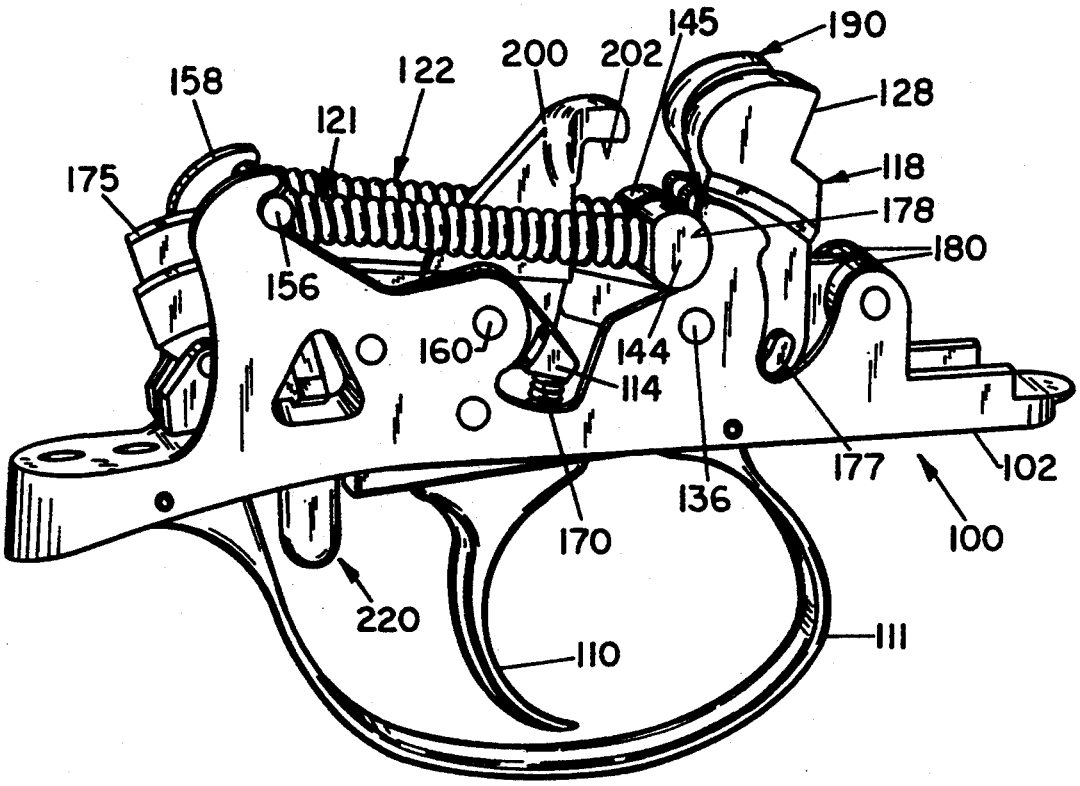
FIG. 13 is a perspective view of the firing mechanism of the shotgun of FIG. 1, having a second hammer configuration provided in the firing mechanism.
Figure 14:
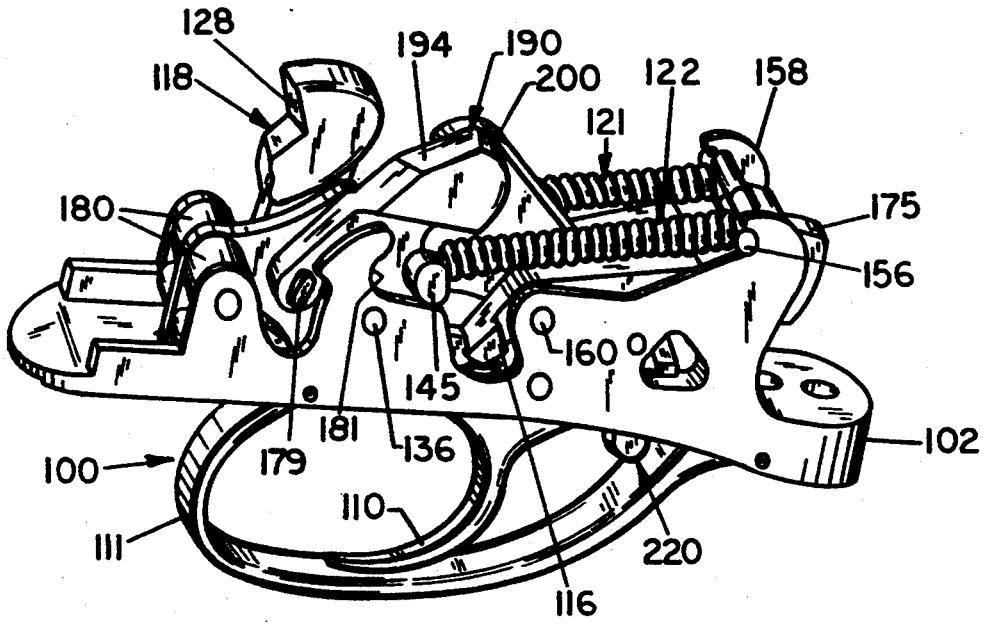
FIG. 14 is a perspective view of the firing mechanism of FIG. 13, shown from the left side of the shotgun, with one of the hammers cocked.
Figure 15:
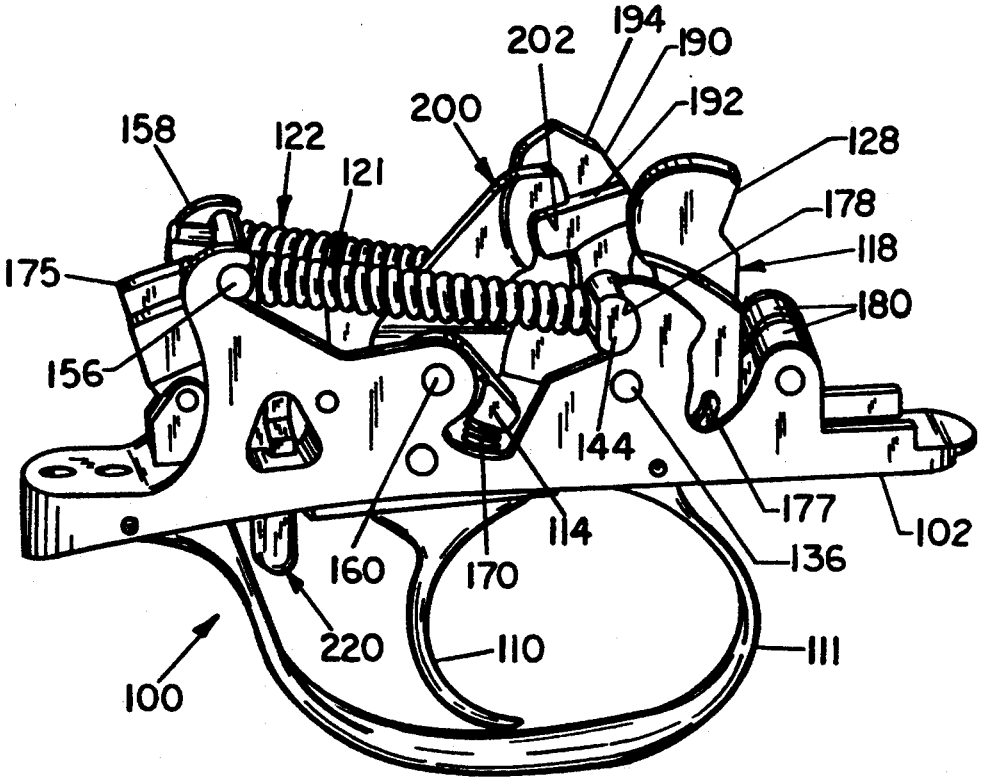
FIG. 15 is a perspective view of the firing mechanism and configuration of FIG. 13, with the other hammer cocked.
Figure 16:
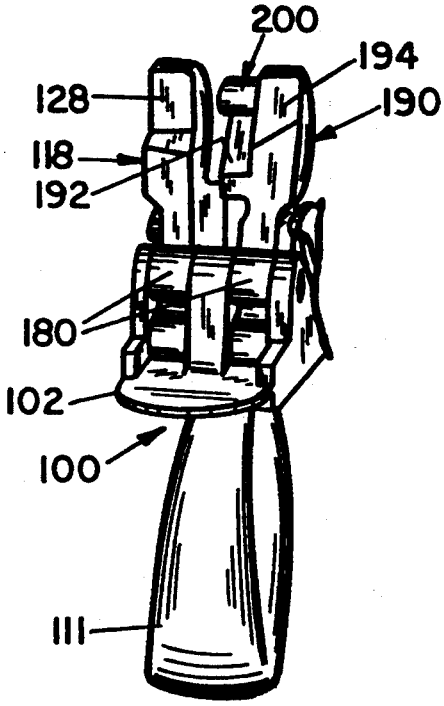
FIG. 16 is a perspective view of the firing mechanism and hammer configuration of FIG. 13, viewed from an end of the firing mechanism.
Figure 19:
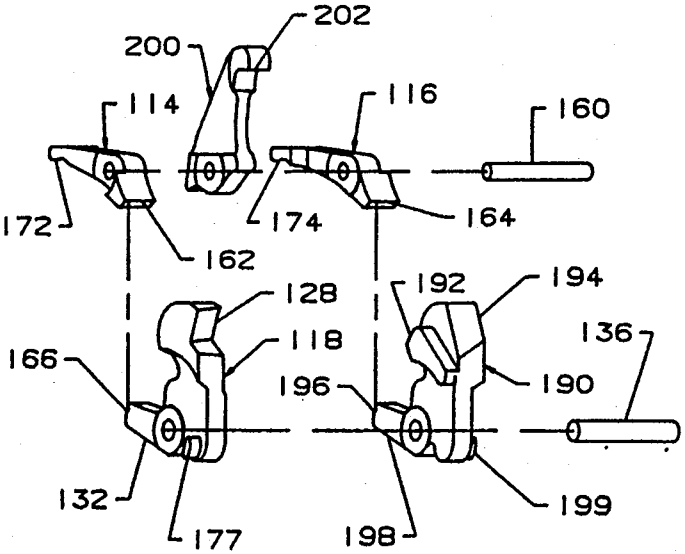
FIG. 19 is an exploded perspective view of the sears, hook, and hammer configuration of the firing mechanism of FIG. 13.
Figure 17:
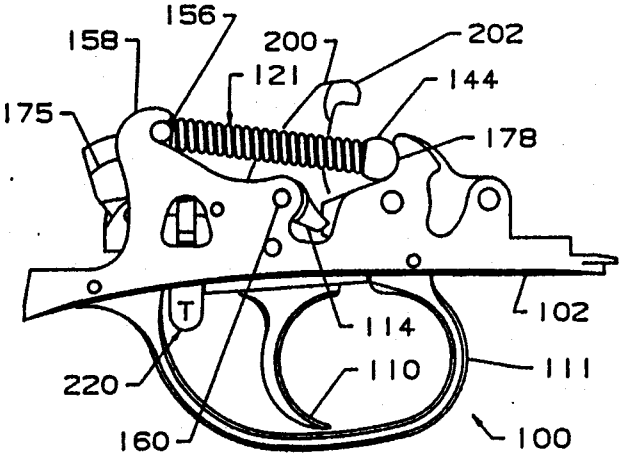
FIG. 17 is an elevation view of the firing mechanism and hammer configuration of FIG. 13, with the hammers removed.
Figure 18:
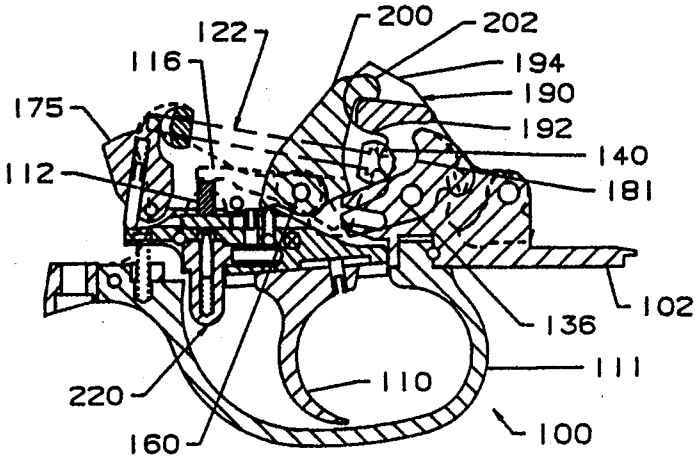
FIG. 18 is a sectional elevation view of the firing mechanism and hammer configuration of FIG. 13 taken through the longitudinal center line of the firing mechanism, with the illustrated hammer cocked.

The firing mechanism of the illustrated embodiment of the invention operates as follows:

First, to ready the shotgun for firing, both of the hammers 118, 120 are cocked through opening of the shotgun via cocking rods 108 and cocking links 180 in a manner which is, per se, well known. The breech 82 is then closed for firing. At this point, as illustrated in FIG. 9, the hammer 118 will be pulled back to a position in which the tooth 162 of sear 114 engages the corresponding notch 166 in the hammer 118. At some point during this motion, the seat 140 of hammer 118 will engage the plunger head 144 of mainspring assembly 121 and lift the plunger head from the seat 178 formed in the trigger housing 102. Further movement of the hammer 118 will compress the spring 146 and push the plunger piston 142 through pin 156. Then, assuming that the bolt actuator lever 254 is in its locked position allowing movement of out of battery pawl 126 and that the safety switch 176 is in its off position allowing movement of pivot member 175, the trigger 110 can be pulled. When the trigger 110 is pulled, acorn 112 rises, thus deflecting sear 114 clockwise around pivot pin 160 against the force of spring 170 and disengaging the sear 114 from the hammer 118.

Figure 12:
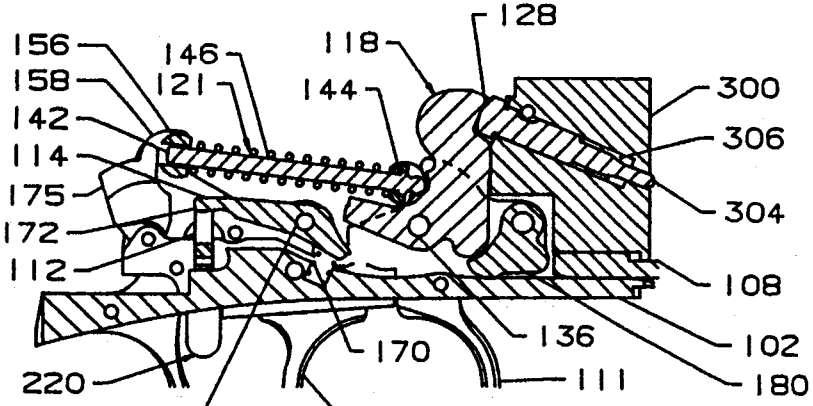
FIG. 12 is a sectional elevation view of the mechanism of FIG. 9, with the illustrated hammer in its fired position.
Figure 11:
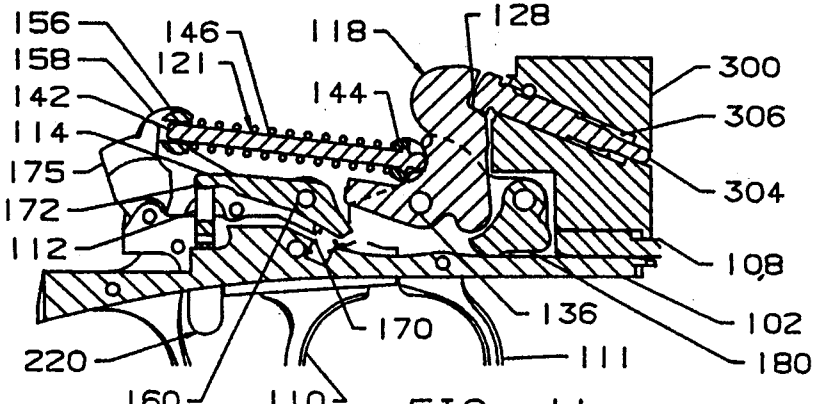
FIG. 11 is a sectional elevation view of the mechanism of FIG. 9, with the illustrated hammer in its released or firing position.
Figure 10:
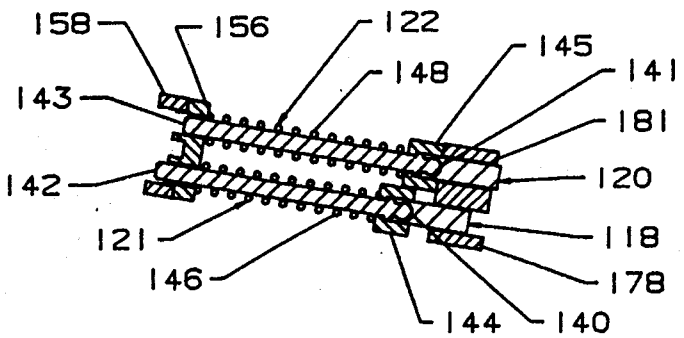
FIG. 10 is a sectional plan view of the mainspring assembly of the firing mechanism of FIG. 2.

At this point, the potential energy stored in the mainspring 146 will drive the hammer 118 through the position illustrated in FIG. 11, in which the hammer first contacts the firing pin 304, and to the bottomed out position illustrated in FIG. 12 in which the firing pin 304 has been positively driven through the receiver front wall 300 by the hammer 118 and has fired the shell present in the corresponding barrel of the shotgun. At a point during this motion proximate that illustrated in FIG. 11, the plunger head 144 will disengage from the seat 140 of hammer 118 and will come to rest on the seat 178 of trigger housing 102. Movement of the hammer 118 beyond the position illustrated in FIG. 12 is prohibited via contact between the hammer 118 and the receiver front wall 300.

After the shotgun has been fired, the hammer 118 will rebound from its own inertia and from the return force of return spring 306 associated with firing pin 304 to the released position illustrated in FIG. 11. Because the plunger head 144 rests upon seat 178 of trigger housing 102 and not on hammer 118, the hammer is not stressed by either the plunger head 144 or the firing pin 304, and there is no stress imposed on the pivot pin 136. Accordingly, the hammer 118 can be removed for replacement simply by removing pin 136.

The ease with which hammers may be removed and replaced in a firing mechanism constructed in accordance with the present invention permits the substitution of so-called release hammers for one or more of the pull-type hammers of the type discussed above. Referring to FIG. 13–19, at least one release-type hammer 190 can be pivotally inserted in the trigger housing 102 via the same pin 136 used to secure a pull-type hammer in the housing. The illustrated release-type hammer 190 is identical in construction and operation to the corresponding pull-type hammer 120 except for the provision of a lobe 192 on the inner surface of the hammer 190. This lobe 192 includes a sloped upper surface which engages a hook 200 in a manner discussed in more detail below. This hammer, like, the pull-type hammer discussed above, includes a contact surface 194 for engagement with a firing pin, and a notch 196 formed in a tail portion 198 thereof for engagement with the tooth 164 of the associated sear 116. An abutment lug 199 is provided on the outside surface of the hammer 190 for engaging the associated tell-tale rod (not shown). To enable the use of the release trigger 190, the out of battery pawl 126 has been replaced by a hook 200 which is connected to the trigger 110 and to the trigger housing 102 via the same pin 160 used to connect the out of battery pawl 126 to the housing 102. Hook 200 includes a pawl 202 which, when the trigger 110 is pulled to pivot the hook 200 forward to the position illustrated in FIG. 18, engages the upper surface of lobe 192 of release hammer 190. This hook, like the out of battery pawl 126, is held in the illustrated forward position when the trigger 110 is pulled, and rotates counter clockwise when the trigger is released.

The firing mechanism operates as follows when a release-type hammer is employed:

The release-type hammer 190 is cocked in the same manner as the pull-type hammer discussed above. Namely, the hammer 190 is rotated about pivot pin 136 when the gun is opened to unseat the mainspring mechanism 122 from the corresponding seat 181 in the housing 102 and then moves against the force of the mainspring mechanism 122 to a position in which the notch 196 in the tail 198 of the hammer 190 lockingly engages the corresponding tooth 164 in sear 116. Assuming that the safety switch 176 has been released, pulling of the trigger 110 will rotate the sear 116 and the hook 200 clockwise, thus disengaging the sear 116 from the hammer 190 and pivoting the pawl 202 of the hook 200 into engagement with the lobe 192 of the hammer 190. Firing of the shotgun is thus prevented by engagement of the hook 202 with the lobe 192. Upon release of the trigger 110, the hook 200 will rotate counter clockwise as viewed in the drawings so that the hook 202 disengages from lobe 192 of hammer 190, thus allowing the hammer 190 to rotate clockwise under the imposition of mainspring mechanism 122 in the same manner as the pull-type hammer discussed above.

Although the illustrated configuration includes one pull-type hammer and one release-type hammer, any combination of hammers could be easily installed in the firing mechanism, including two pull hammers, two release hammers, or pull and release hammers having their orders reversed from that illustrated in the drawings.

2. Selector Switch

As discussed above, firing of a given barrel of the shotgun is achieved through vertical pivoting of the acorn member 112. Selection of the first barrel to fire can be achieved through actuation of a selector switch 220 which laterally pivots the acorn 112 between the respective sears 114, 116.

Referring to FIGS. 1 and 20–23*e*, this selector switch 220 includes a generally L-shaped switch portion 222 having a first leg 224 which extends longitudinally through the trigger body 239 and which is pivotable about the longitudinal axis of the trigger body, and a second leg 226 which extends downwardly from the trigger body 239 and which forms a switch which is accessible by the thumb or finger of the shotgun operator. The acorn 112 and the selector switch 220 are mounted together on trigger body 239 for pivoting longitudinally upon actuation of the trigger 110.

The second leg 226 of switch body 222 has a longitudinal recess formed therein which accommodates a tapered engagement mechanism 228 and a spring 230. The spring 230 biases the engagement mechanism 228 into contact with a lower surface 232 of acorn 112. The acorn 112 is laterally pivotable about a pivot pin 234 connecting the acorn 112 to trigger body 239 such that its head 236 selectably engages one or the other of the legs 172, 174 of the sears 114, 116. The lower surface 232 of acorn 112 includes a pair of lugs 238 which abut the trigger body 239 when the acorn 112 is pivoted. The switch body 222 is biased into one or the other of its rest positions by a spring loaded ball detent 225.

Figure 23E:
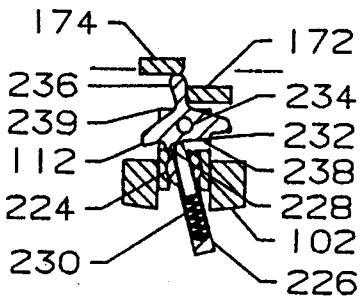
FIGS. 23*a–e* are sectional end views of the acorn mechanism and selector switch of FIG. 21, with the selector switch and acorn being illustrated in various operational positions.
Figure 23D:
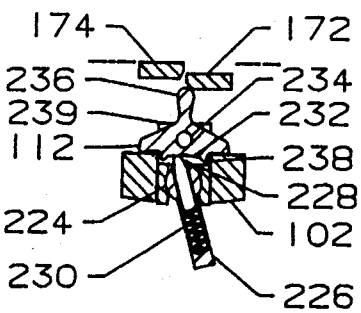
Figure 23C:
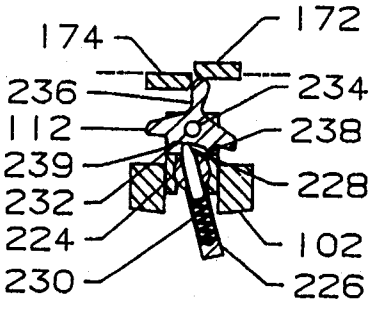
Figure 23B:
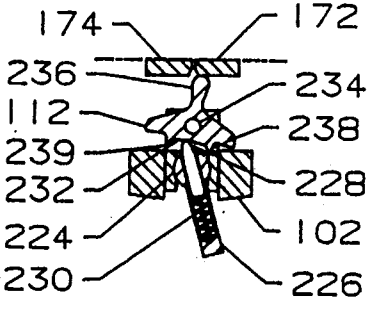
Figure 23A:
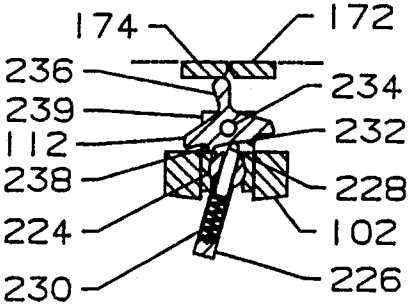

The selector switch 220 operates as follows:

Initially, the acorn 112 and selector switch 220 may be in the position illustrated in FIG. 23a when both hammers of the firing mechanism 100 are cocked. In this position, the sears 114, 116 will be pivoted clockwise to a position in which the head 236 of acorn 112 is located in light contact with the legs 172, 174 of the sears, and the acorn 112 and selector switch 220 will be in their positions of rest in which the switch portion 222 of switch 220 is completely received in the bore formed in trigger body 239. At this time, the head 236 of acorn 112 engages leg 174 of sear 116.

Assuming that the operator desires to fire the shell in the barrel associated with sear 114 first, he or she will push the leg 226 of the switch portion 222 of selector switch 220 with his or her thumb or finger from the position illustrated in FIG. **23*a* to that illustrated in FIG. 23*b*. This motion causes the switch body 222 to rotate in trigger body 239 so that the engagement mechanism 228 rotates to the position illustrated in FIG. 23*b*, thus pivoting the acorn 112 about pivot pin 234 so that the head 236 is in engagement with the leg 172 of sear 114**.

Upon actuation of the trigger, the acorn 112 and the switch 220 will rise. The right lug 238 of acorn 112 will be supported on the trigger body 239 during this movement, thus preventing further pivoting of the acorn and assuring firm contact between the acorn and the leg 172 of the sear 114. Accordingly, the leg 172 of sear 114 will be lifted as illustrated in FIG. **23*c***, thus pivoting the sear and firing the gun in the manner discussed above.

After the barrel associated with sear 114 is fired, the associated hammer will no longer impose a biasing force on the sear. Accordingly, the leg 172 of sear 114 will drop down below the leg 174 of sear 116 through the position illustrated in FIG. **23*d* to its position of rest illustrated in FIG. 23*e*. Upon release of the trigger, the trigger body 239, acorn 112, and switch 220 will drop down to the position illustrated in FIG. 23*d*, and the trigger body 239 will then rise back up to the position illustrated in FIGS. 23*a* and 23*b* as the acorn 112 pivots about pivot pin 234 such that the head 236 of acorn 112 contacts but does not lift leg 174 of sear 116 and the left abutment lug 238 rests on trigger body 239**.

When the trigger 110 is pulled a second time, the head 236 of acorn 112 will lift leg 174 of sear 116 as illustrated in FIG. 23e. Because the left lug 238 of acorn 112 will be supported on the trigger body 239 during this movement, further pivoting of the acorn of acorn 112 is prevented, thus assuring firm contact between the head 236 of acorn 112 and the leg 174 of the sear 116. Accordingly, the leg 174 of sear 116 will pivot the sear and fire the second barrel of the gun in the manner discussed above.

By providing a selector switch which is located behind the trigger and which is in direct contact with the bottom of the acorn 112, complicated wires and other connectors of conventional switches are eliminated. In addition, the disclosed acorn and sear arrangement do not require recoil forces to reset the trigger for firing the second barrel. The firing mechanism can therefore be used with even the smallest caliber shotgun.

Bolt Actuator

Referring to FIGS. 1 and 24–27, bolt actuator 250 drives bolt 252 into and out of engagement with breech 82 of the double barrel 80 and includes a lever 254, an actuator 256 which is attached to the lever 254 via a screw 258, and an engagement mechanism 260 which is provided on the bolt 252.

The bolt 252 and the engagement mechanism 260 are preferably cast from the same piece of metal with the engagement mechanism comprising a pair of islands which extend above the generally planar surface of the bolt to define a recess therebetween. The bolt 252 further includes a pair of legs 262, 264 which project through the receiver front wall 300 and which, in their locked position, extend into corresponding holes formed in the breech 82 of the double barrel 80. An island 265 is provided for engagement with an out of battery plunger 280 to be discussed in more detail below.

The actuator 256 includes a generally central bore 266 for receiving screw 258, which bore is reamed out on the lower surface of the actuator such that the head of the screw 258 lies flush which the lower surface of the actuator when the bolt actuator is assembled. A pair of curved legs 268, 270 extend outwardly from the bore 266 of actuator 256, one of which engages a spring biased plunger 269 and the other of which is received in the recess formed between the islands constituting the engagement device 260 of bolt 250. The end 270 which engages the engagement device 260 is cammed so as to produce movement of the engagement device and thus of the bolt longitudinally of the shotgun upon pivoting of the actuator 256.

Figures 24, 25, 26, 27:
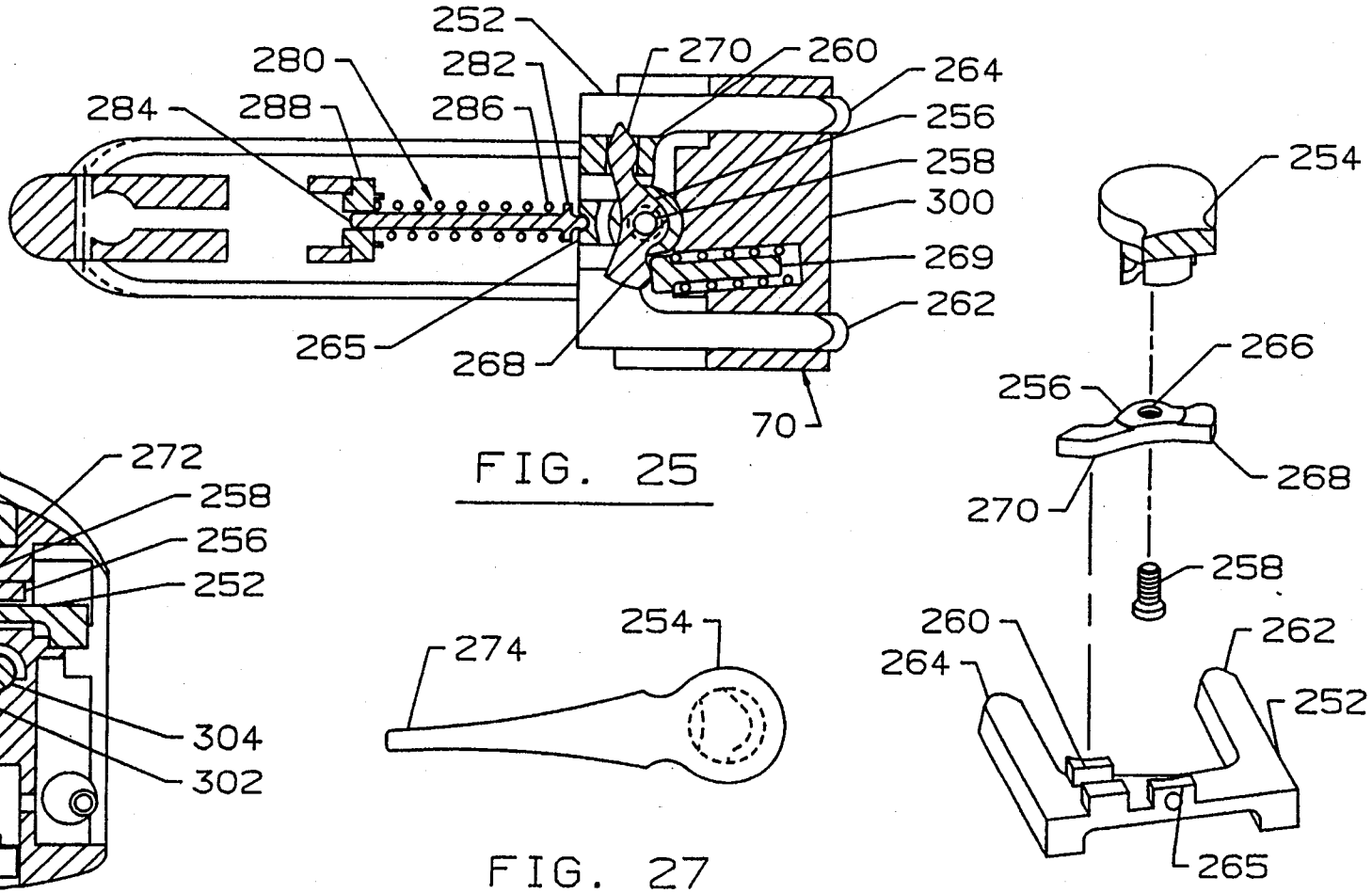
FIG. 24 is a sectional view of the receiver of the shotgun of FIG. 1, taken along the lines 24–24 in FIG. 1.
FIG. 25 is a sectional view of the receiver of the shotgun of FIG. 1, taken along the lines 25–25 in FIG. 1.
FIG. 26 is an exploded perspective view of the bolt actuator of FIGS. 1, 24, and 25.
FIG. 27 is a plan view of the bolt actuator lever of FIG. 1.
Figure 28:
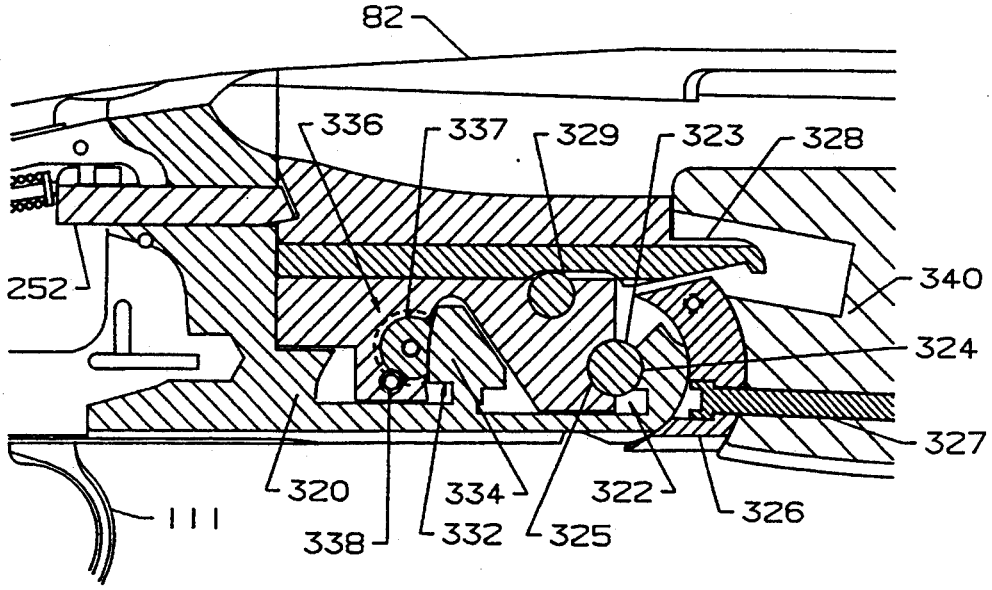
FIG. 28 is a sectional elevation view of a portion of the shotgun of FIG. 1, taken along a line near a lateral edge of the shotgun with the breech in its closed and locked position.
Figure 29:
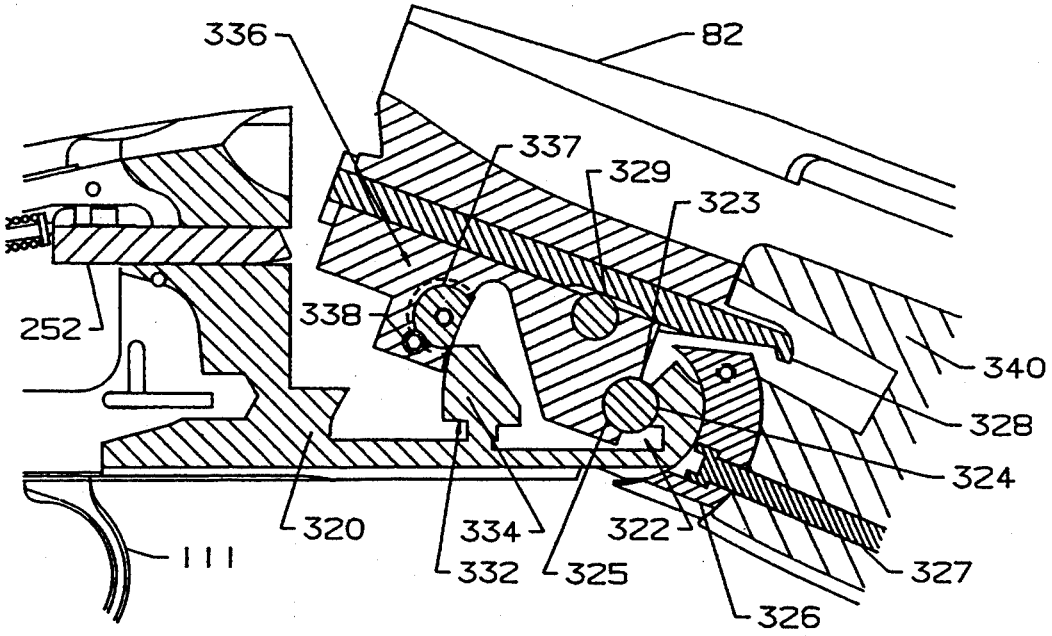
FIG. 29 shows the shotgun as illustrated in FIG. 28, with the breech in an unlocked and slightly open position.
Figure 30:
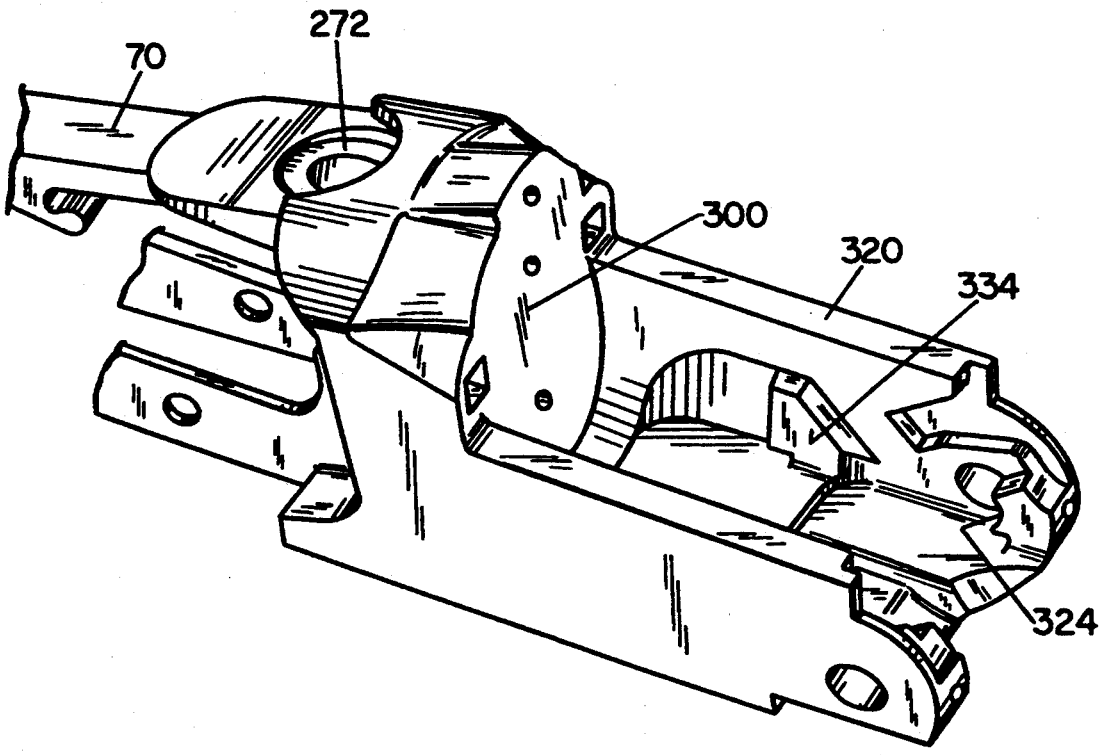
FIG. 30 is a perspective view of the breech housing of FIGS. 28 and 29.
Figure 31:
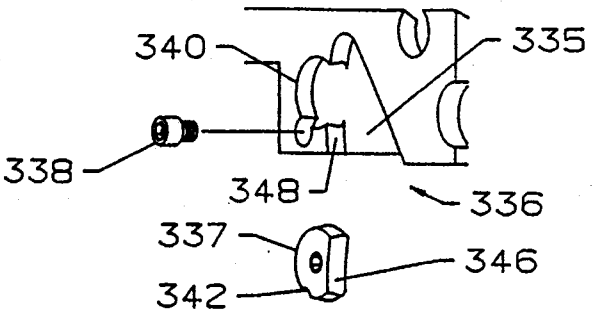
FIG. 31 is an exploded perspective view illustrating the second abutment lug of FIGS. 28–30.
Figure 32:
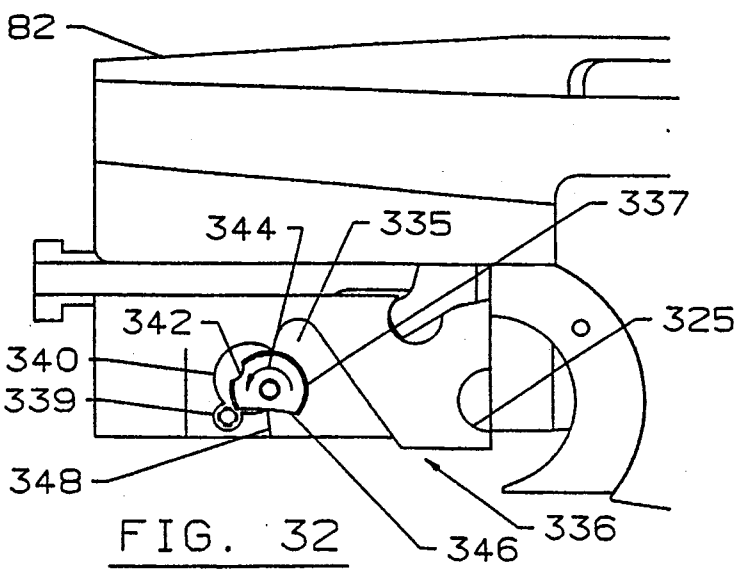
FIGS. 32 and 33 are elevation views illustrating the manner in which the shoulder of the second abutment lug of FIGS. 28–31 is inserted into the breech.
Figure 34:
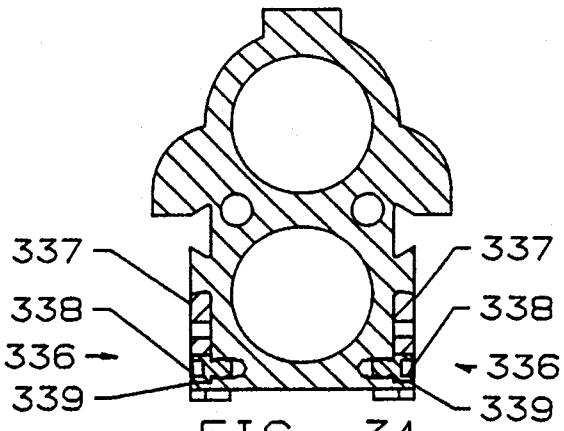
FIG. 34 is a sectional end view of FIG. 33.

Lever 254 is threaded to receive the free end of screw 258 and is stepped so as to mate with a stepped bore 272 in receiver 70. As illustrated in FIG. 24, the bolt actuator is held in position by drawing the actuator into contact with the receiver 70 as the screw 258 is tightened to draw the lever 254 into contact with the stepped bore of the receiver. Thus, the lever 254 and actuator 256 can pivot with respect to receiver 70 but cannot be removed from the receiver. The lever 254 includes an enlarged thumb catch 274 and, in the locked position, extends generally collinear with the longitudinal center line of the shotgun. A conventional spring loaded return mechanism 279 (FIG. 1) is provided for retaining the lever 254 in its opened position when the breech 82 is opened.

The plunger assembly 280 includes a plunger head 282 which engages the island 265 of bolt 252, a plunger piston 284, and a biasing spring 286 which surrounds the plunger piston. The plunger piston 254 is slidably received in a support 288 fixed to receiver 70.

The bolt actuator 250 operates as follows:

During normal use when the breech 82 is closed and locked and the lever 254 extends generally collinear with the longitudinal center line of the gun, the actuator 256 will be pivoted to a position causing the legs 262 and 264 of bolt 252 to extend through the receiver front wall 300 and into the mating bores in the breech 82. The spring biased plunger 269 aids in biasing the actuator 256 and bolt 252 into this position.

Assuming that it is desired to open the breech for extraction and/or reloading of shells, the lever 274 is pivoted counter clockwise about stepped bore 272 of receiver 70, thus causing the actuator 256 to rotate counter clockwise against the force of the spring biased plunger 269. During this rotation, cooperation between the cammed surface of the end 270 of actuator 256 and the engagement device 260 effects withdrawal of the legs 262, 264 of the bolt 252 from the breech 82 and into the receiver front wall 300. The breech 82 is now free to pivot open with respect to the receiver 70.

When the bolt 252 is withdrawn into the receiver 70, the plunger piston 284 is driven through the support 288 against the bias spring 286 and engages the out of battery pawl 126. This engagement prevents the trigger from being pulled so long as the lever 254 is out of the locked position.

The ends of the legs 262 and 264 of bolt 252 may become worn through repeated use. As a result, the ends will not protrude as far into the bores of the breech 82 when the gun is closed, nor will the lever 254 return to a position in which it is collinear with the longitudinal center line of the gun. To alleviate this problem without replacing the bolt, the actuator 256 can be replaced with one having a slightly different shape which effects greater movement of the bolt 254 upon the same degree of rotation of the actuator. The resulting mechanism would provide greater extension of the bolt when the breech 82 is closed, thus compensating for wear of the bolt.

By providing an actuator which is of lighter construction and separable from the bolt and the lever, the actuator 256 will break prior to the bolt or lever upon the imposition of excessive forces on either the bolt or the lever. The actuator can then be replaced simply by removing the lever 254 from the receiver 70 and by removing screw 258. In addition, the disclosed bolt actuator can be disassembled simply by removing a single pin, and is thus much easier to disassemble than other known arrangements which require the removal of one or more keys. This in turn facilitates the substitution of actuators to compensate for bolt wear.

Bifurcated Lug

The breech or barrel rear end 82 of the double barrel 80 is received in a breech housing 320 which is formed integral with receiver 70. Referring to FIGS. 1 and 28–34, the breech 82 is pivotally secured to the breech housing 320 via a pivot connection 322 including a pivot pin 323 connecting a first joint 324 on the breech housing 320 to a second joint 325 on the breech 82. A fore end iron 326 is mounted to the breech 82 and receives a mounting screw 327 for fore end 340. In addition, a shell ejector 328 may be provided, the movement of which is limited by a stop 329. The cocking rod 108 is spring loaded by plunger 106 (FIGS. 1, 9, 11, and 12) and extends through the breech housing 320 and cooperates with the breech 82 and the cocking link 180 in a manner which is discussed above and which is, per se, well known.

Pursuant to the invention, a bifurcated lug 332 is also provided to assure a snug fit between the breech 82 and the breech housing 320 when the breech is in its closed position. This bifurcated lug 332 includes a first generally triangular lug 334 which is formed integral with breech housing 320 and which can be received in a recess formed in the breech 82. A second lug 336 is provided in the breech 82 and includes a shoulder 337 having a front surface 346 (FIGS. 31–33) which is slightly curved and which compliments the shape of the rear surface of the first lug 334. The mating surfaces have a common center of rotation with pivot pin 323. The shoulder 337 is removable from the breech 82 and is secured to the breech 82 by a screw 338 which engages a notch 342 formed in the shoulder 337. The first lug 334 and the shoulder 337 of second lug 336 are designed with close tolerances so that a snug fit may be formed therebetween.

The bifurcated lug 332 operates as follows:

When the breech is in its fully opened position, the lugs 334 and 336 are spaced from one another, and both barrels of the shotgun are easily accessible for extraction and replacement of shells. Breech 82 is then rotated counter clockwise as viewed in the drawings around pivot pin 323 to close the breech. During this rotation, shoulder 337 of lug 336 rotates around lug 334 from the partially open position illustrated in FIG. 29 to the completely closed position illustrated in FIG. 28. Preferably, the two lugs 334, 336 are designed so that the mating sloped surfaces of the lugs slidably engage one another when the breech is pivoted into the breech housing. When the breech 82 is closed and locked, a snug fit is formed between lugs 334 and 36.

Upon firing of the shotgun 50, the recoil forces from the breech 82 will be imposed on the breech housing 320 primarily on the first abutment lug 334 and on the shoulder 337 of the second abutment lug 336 and not on pivot pin 323. Accordingly, the pivot pin is not subject to wear, and the desired tolerances between the breech 82 and the receiver 70 can be maintained, even after repeated firings.

Preferably, the replaceable shoulder 337 of second lug 336 is formed from a softer metal then is permanent lug 334 so that shoulder 337 will wear first. If this shoulder becomes worn through repeated firings so that the desired tolerances are no longer maintained between the two lugs, the shoulder 337 of lug 336 can be replaced by removing the screw 338 and by replacing the worn shoulder 337 with a new one.

Figure 33:
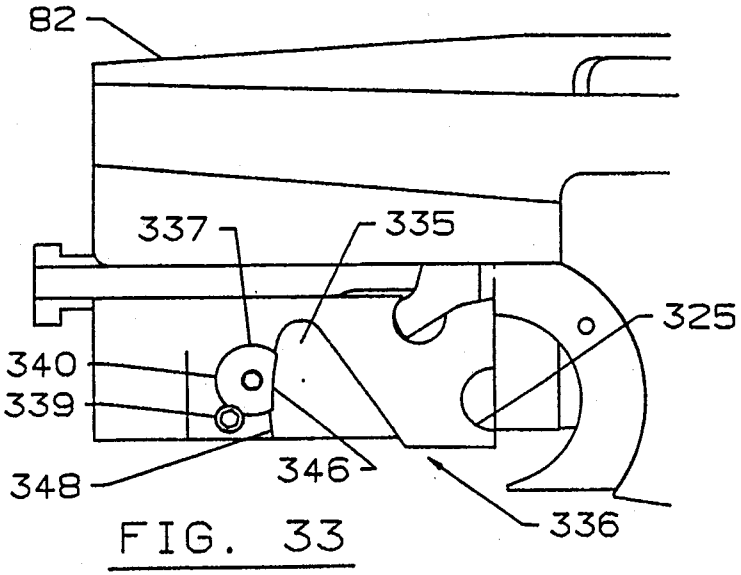

Referring to FIGS. 31–34, the second lug 336 is assembled as follows:

First, the shoulder 337 is inserted into the breech 82 by inserting the end of the shoulder 337 containing notch 342 through the triangular recess 335 of breech 82 and into a socket 340 for the shoulder 337. The shoulder 337 is then rotated in the direction of arrow 344 in FIG. 32 so that the shoulder 337 rotates into the socket 340 to the position illustrated in FIG. 33 in which the notch 342 of shoulder 337 is disposed adjacent a bore 339 for receiving screw 338 and in which the slightly arcuate front face 346 of shoulder 337 is generally aligned with the rear face 348 of recess 335. As is readily evident from the drawings, nearly the entire shoulder 337 except for the surface 346 is received in the socket 340 at this time. The screw 338 is then inserted into the bore 339 as illustrated in FIG. 33 so that its head is received in the notch 342 formed in shoulder 337, thus preventing the shoulder 337 from rotating with respect to the breech 82. The shoulder 337 can be removed for replacement simply by reversing the steps discussed above.

It should be appreciated that many modifications could be made to the disclosed device without departing from the spirit and scope of the invention. For example, the disclosed rebound system, bolt actuator, and bifurcated lug are not limited to use with a double barrel shotgun but could be used with virtually any break-action shotgun. Moreover, the rebound system could be used with virtually any firearm.

What is claimed is:

1. A firearm comprising:

(A) a breech housing;

(B) a barrel pivotally mounted in said breech housing via a pivot member and having a rear end portion which (1) extends rearwardly from said pivot member, (2) terminates in a rear end, and (3) is receivable in said breech housing;

(C) a first, stationary abutment lug which is provided on said end portion of said barrel between said pivot member and said rear end and which extends towards said breech housing; and (D) a second, stationary abutment lug which is provided on said breech housing and which extends towards said first abutment lug, one of said first and second abutment lugs including a replaceable shoulder which abuts the other of said first and second abutment lugs when said end portion of said barrel is pivoted to a closed position within said breech housing to provide a snug fit between said end portion of said barrel and said breech housing, said replaceable shoulder being inserted into a socket formed in said one abutment lug, wherein nearly all of said shoulder except for an abutment surface thereof is received within said socket.

2. A firearm according to claim 1, wherein said first abutment lug and said shoulder have mating sloped surfaces which slidably engage one another when said end portion of said barrel is pivoted into said breech housing.

3. A firearm according to claim 2, wherein said second abutment lug is formed integral with said breech housing and said shoulder is insertable into said first abutment lug, and further comprising a retainer which is provided in said end portion of said barrel and which holds said shoulder in said first abutment lug.

4. A firearm according to claim 3, wherein said shoulder includes a notch on an outside surface thereof for engagement with said retainer.

5. A firearm according to claim 4, wherein said retainer comprises a screw.

6. A firearm according to claim 1, wherein said shoulder is formed from a first, relatively soft metal and the other of said first and second abutment lugs is formed from a second, relatively hard metal.

7. A firearm comprising:

(A) a breech housing;

(B) a barrel pivotally attached to said breech housing via a pivot member and having a rear end portion which (1) extends rearwardly from said pivot member, (2) terminates in a rear end, and (3) is receivable in said breech housing;

(C) a first, stationary abutment lug which (1) is provided on said end portion of said barrel between said pivot member and said rear end, (2) extends towards said breech housing, and (3) presents a first sloped surface; and (D) a second, stationary abutment lug which is provided on said breech housing and which presents a second sloped surface, said second sloped surface having a shape which complements that of said first sloped surface and which slidably engages said first sloped surface when said end portion of said barrel is pivoted into a closed position within said breech housing, wherein one of said first and second abutment lugs includes a replaceable shoulder having a sloped surface forming a portion of the corresponding one of said first and second sloped surfaces, said replaceable shoulder being inserted into a socket formed in said one abutment lug, wherein nearly all of said shoulder except for said sloped surface thereof is received within said socket.

8. A firearm according to claim 7, wherein said second abutment lug is formed integral with said breech housing and said shoulder is insertable into said first abutment lug, and further comprising a retainer which is provided in said first abutment lug and which engages a notch formed in a side edge of said shoulder to hold said shoulder in said first abutment lug.

9. A firearm comprising:

(A) a breech housing;

(B) a barrel pivotally attached to said breech housing via a pivot member and having a rear end portion which (1) extends rearwardly from said pivot member, (2) terminates in a rear end, and (3) is receivable in said breech housing;

(C) a first, stationary abutment lug which (1) is provided on said breech housing, (2) extends towards said end portion of said barrel, and (3) presents a first sloped surface; and (D) a second, stationary abutment lug which (1) is provided on said end portion of said barrel between said pivot member and said rear end, (2) extends towards said breech housing, and (3) presents a second sloped surface, said second sloped surface having a shape which complements that of said first sloped surface and which slidably engages said first sloped surface when said end portion of said barrel is pivoted into a closed position within said breech housing, said second abutment lug comprising a replaceable shoulder presenting at least a portion of said second sloped surface, said replaceable shoulder being inserted into a socket formed in said second abutment lug, wherein nearly all of said shoulder except for said portion of said second sloped surface is received within said socket.

10. A process comprising:

(A) providing a firearm having a breech housing, a barrel pivotally mounted in said breech housing via a pivot member and having a rear end portion extending rearwardly form said pivot member to a rear end, and a stationary abutment lug which is provided on one of the end portion of said barrel and the breech housing between said pivot member and said rear end and which engages a mating stationary abutment lug on the other of said end portion of said barrel and breech housing when said end portion of said barrel is pivoted to a closed position within said breech housing, and (B) inserting a shoulder in said abutment lug comprising the steps of (1) inserting said shoulder in a socket formed in said abutment lug such that nearly all of said shoulder except for an abutment surface thereof is received within said socket; and then (2) fastening said shoulder to said abutment lug.

11. A process according to claim 10, wherein said step (B)(1) comprises inserting said shoulder into said socket and then rotating said shoulder to a position in which a notch formed in a side edge of said shoulder is disposed adjacent a bore formed in said socket, and wherein said step (B)(2) comprises inserting a retainer into said bore such that a portion of said retainer is received in said notch, thus preventing said shoulder from rotating with respect to said socket.

12. A firearm comprising:

(A) a breech housing;

(B) a barrel pivotally mounted on said breech housing via a pivot member and having a rear end portion which (1) extends rearwardly from said pivot member, (2) terminates in rear end, and (3) is receivable in said breech housing;

(C) a stationary abutment lug which (1) is provided on one of said breech housing and said end portion of said barrel, (2) is located between said pivot member and said rear end, and (3) extends towards the other of said breech housing and said end portion of said barrel; and (D) a replaceable shoulder which is inserted into a socket formed in said abutment lug and which is fastened to said abutment lug, wherein nearly all of said shoulder except for an abutment surface thereof is received within said socket.

13. A firearm according to claim 12, further comprising a retainer which holds said shoulder in said socket.

14. A firearm according to claim 13, wherein a bore is formed in said socket, said shoulder is rotatable into said socket and includes a notch which is disposed adjacent said bore when said shoulder is rotated into said socket, and wherein said retainer is inserted into said bore such that a portion of said retainer is received in said notch, thereby preventing said shoulder from rotating with respect to said socket.

15. A firearm comprising:

(A) a breech housing;

(B) a barrel pivotally mounted on said breech housing via a pivot member and having a rear end portion which (1) extends rearwardly from said pivot member, (2) terminates in a rear end, and (3) is receivable in said breech housing;

(C) a first, stationary abutment lug which (1) is provided on one of said breech housing and said end portion of said barrel, (2) is located between said pivot member and said rear end, and (3) extends towards the other of said breech housing and said end portion of said barrel; and (D) a second, stationary abutment lug including (1) a socket formed in the other of said breech housing and said end portion of said barrel and which has a bore formed therein, (2) a shoulder which is rotatable into said socket and which has a notch formed on a side edge thereof which is disposed adjacent said bore when said shoulder is rotated into said socket, and (3) a retainer which is inserted into said bore such that a portion of said retainer is received in said notch, thereby preventing said shoulder from rotating with respect to said socket and thereby holding said shoulder in said socket, wherein nearly all of said shoulder except for an abutment surface thereof is received within said socket, said shoulder and said first abutment lug abut one another to provide a snug fit between said barrel and said breech housing, and said shoulder is formed from a first, relatively soft metal and said first abutment lug is formed from a second, relatively hard metal.

* * * * *